US005431585A

United States Patent [19]

Fan

[11] Patent Number: 5,431,585

[45] Date of Patent: Jul. 11, 1995

[54] CAR CIRCUIT ADAPTER

[76] Inventor: Eagle Fan, No. 30, Lu-Chang, Chu-Pei City, Hsinchu Hsien, Taiwan

[21] Appl. No.: 241,801

[22] Filed: May 12, 1994

[51] Int. Cl.[6] ..... H01R 17/18

[52] U.S. Cl. ..... 439/668; 439/638; 439/34

[58] Field of Search ..... 439/638–655, 439/668, 669, 34, 675

[56] References Cited

U.S. PATENT DOCUMENTS

| | | | |
|---|---|---|---|
| 4,054,352 | 10/1977 | Rudin | 439/638 |
| 4,109,988 | 8/1978 | Olson | 439/638 |
| 4,322,122 | 3/1982 | Schwartz et al. | 439/668 |
| 5,007,863 | 4/1991 | Xuan | 439/639 |
| 5,326,283 | 7/1994 | Chen | 439/638 |

*Primary Examiner*—David L. Pirlot
*Attorney, Agent, or Firm*—Notaro & Michalos

[57] ABSTRACT

A car circuit adapter disclosed includes a housing, an electrically conductive connector serving as anode and an electrically conductive member serving as cathode in order to electrically connect a car cigarette lighter so as to provide battery power, a compass for decorating as well as indicating the car location, a lighting device for brightening the compass and indicating the connecting status of the electrically conductive connector and electrically conductive member with the car cigarette lighter, and an extendable power cord in electrical connection with the electrically conductive connector and member for a distant user capable to utilize battery power.

3 Claims, 2 Drawing Sheets

CAR CIRCUIT ADAPTER

FIELD OF THE INVENTION

The present invention relates generally to a car circuit adapter for a distant user capable to utilize battery power and more particularly to the car circuit adapter comprising a compass and a lighting device.

BACKGROUND OF THE INVENTION

A conventional car circuit adapter is, generally, a very simple structure comprising an electrically conductive terminal serving as anode and an electrically conductive terminal serving as cathode in order to electrically connect a car cigarette lighter so as to provide battery power.

But, the design of the conventional car circuit adapter is too dull to be attractable. And, the function of the conventional car circuit adapter is also too simple to satisfy a user. For example, the conventional car circuit adapter is unable to show an on/off status when the conventional connector is in electrical connection with the car cigarette lighter.

SUMMARY OF THE INVENTION

Accordingly, it is a primary object of the present invention to provide a car circuit adapter to overcome the problems in the prior art.

In accordance with the above-mentioned object, a car circuit adapter comprises a housing, an electrically conductive connector serving as anode and an electrically conductive member serving as cathode in order to electrically connect a car cigarette lighter so as to provide battery power, a compass for decorating as well as indicating car location, a lighting device for brightening the compass and indicating the connecting status of the electrically conductive connector and member with the car cigarette lighter, and an extendable power cord in electrical connection with the electrically conductive connector and member for a distant user capable to utilize battery power.

The above object, features and advantages of the invention will become readily apparent from the following detailed description thereof which is to be read in connection with the accompanying drawings.

DETAILED DESCRIPTION OF THE PREFERRED EMBODIMENT

Figure 1:
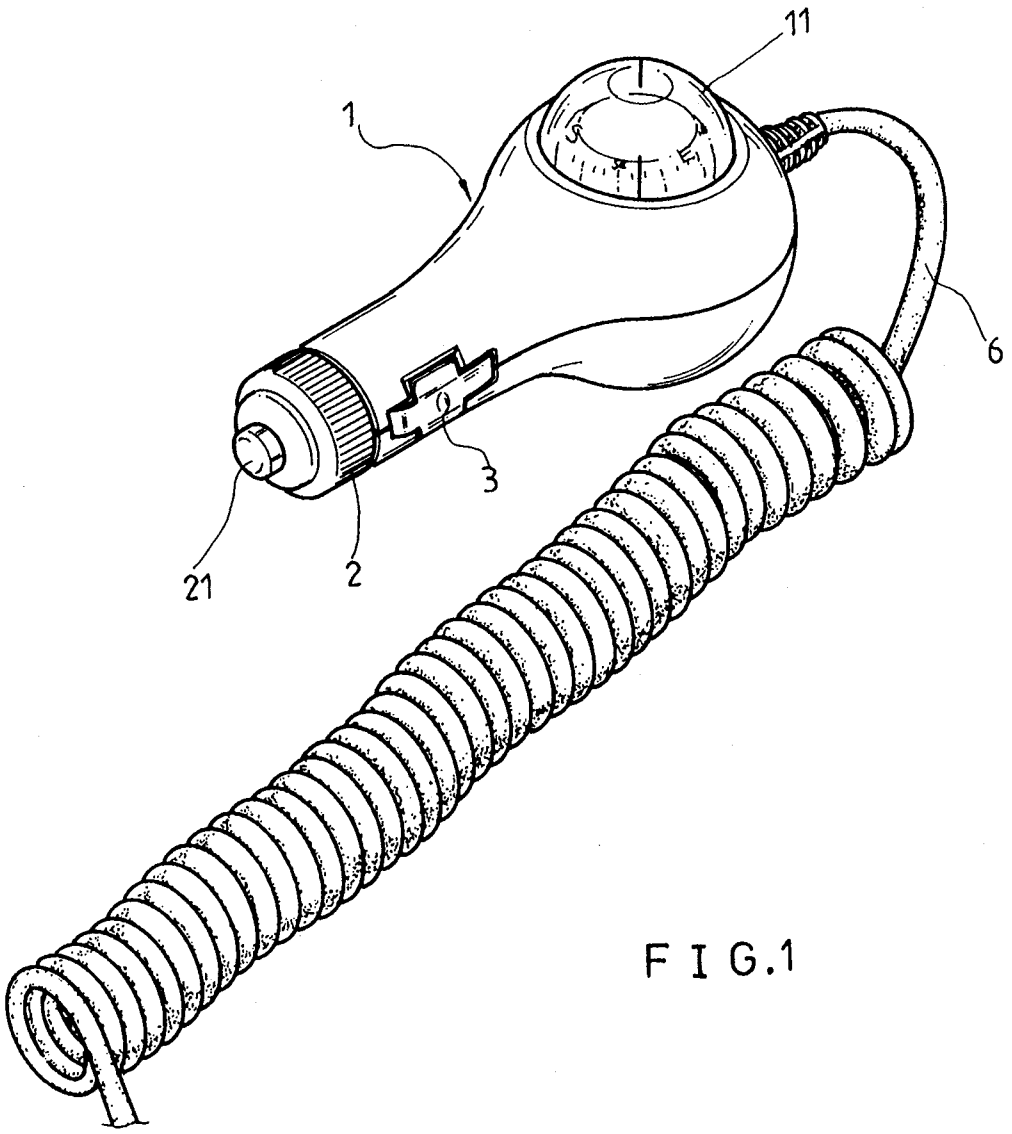
FIG. 1 is a perspective view of a car circuit adapter constructed in accordance with the present invention.
Figure 2:
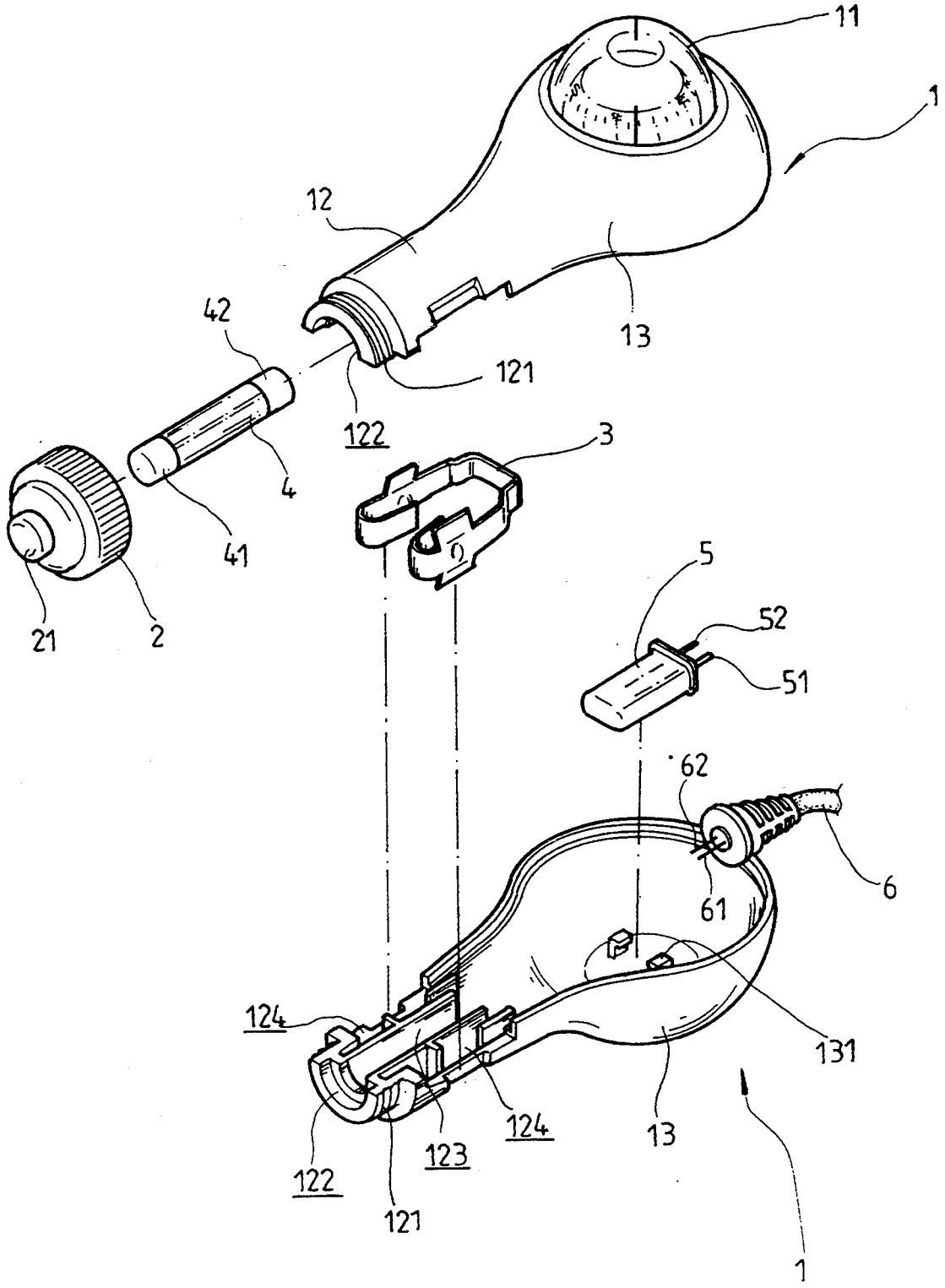
FIG. 2 is an exploded perspective view of the car circuit adapter constructed in accordance with the present invention.

Referring to FIGS. 1 and 2, a car circuit adapter constructed in accordance with the present invention is shown. The car circuit adapter comprises a bulb-shaped housing 1 defining an internal space, an electrically conductive connector 2 serving as anode and an electrically conductive member 3 serving as cathode in order to electrically connect a car cigarette lighter which is not shown in the drawings. The car circuit adapter further comprises a plug fuse 4 and a lighting element 5, which are receivable within the internal space of the housing 1 and in electrical connection with the electrically conductive connector 2 and member 3. And, the car circuit adapter also comprises an extendable power cord 6 which is partially receivable within the internal space of the housing 1 and in electrical connection with the electrically conductive connector 2 and member 3 for a distant user capable to utilize battery power. The car battery, which is not shown in the drawings, is in electrical connection with the car cigarette lighter.

The bulb-shaped housing 1, which is constructed with two pieces, comprises a compass 11 mounted thereto externally for decorating as well as indicating car location. The bulb-shaped housing 1 comprises a tubular end portion 12 including an externally-threaded end 121 to be screwedly connectable to the connector 2 having a side opening 122 formed thereon for the plug fuse 4 to extend therethrough and electrically contact the connector 4, an internal tubular chamber 123 formed thereon for receiving therein the plug fuse 4, and a pair of side chambers 124 formed thereon for securely receiving therein the electrically conductive member 3. The bulb-shaped housing 1 comprises a ball head portion 13 including a fixture 131 formed therein to fix the lighting element 4 thereto.

The electrically conductive connector 2 serving as anode comprises a front projecting contact 21 formed thereon to be electrically contactable with the car cigarette lighter in an engaging manner. The electrically conductive connector 2 further comprises an internal thread (unshown here) formed on the inner surface thereof to be screwedly connectable to the externally-threaded end 121 of the housing 1 so as to securely lock the two-piece housing 1.

The electrically conductive member 3 serving as cathode is securely receivable within the side chamber 124 of the housing 1 and partially exterior to the housing 1 so as to electrically contact the car cigarette lighter.

The plug fuse 4 comprises two electrically conductive terminals 41, 42 mounted thereto. The terminal 41 is in electrical connection with the projecting contact 21 of the electrically conductive connector 2 and the terminal 42 is in electrical connection with the electrically conductive member 3.

The lighting element 5 comprises two electrically conductive terminals 51, 52 mounted thereto. The terminal 51 is in electrical connection with the electrically conductive connector 2 and the terminal 52 is in electrical connection with the electrically conductive member 3. The lighting element 5 is provided for brightening the compass 11 and indicating the connecting status of the electrically conductive connector 2 and member 3 with the car cigarette lighter.

The extendable power cord 6 comprises two electrically conductive terminals 61, 62 mounted thereto. The terminal 61 is in electrical connection with the electrically conductive connector 2 and the terminal 62 is in electrical connection with the electrically conductive member 3. The extendable power cord 6 is provided for a distant user capable to utilize battery power.

Therefore, when the adapter is inserted into the car cigarette lighter, the electrically conductive connector 2 which serves as anode and the electrically conductive member 3 which serves as cathode electrically contact the car cigarette lighter to be ready to serve.

Having described the specific preferred embodiment of the present invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A car circuit adapter comprising a housing, which defines an internal housing, including a compass mounted thereto externally for decorating as well as indicating car location; an electrically conductive connector serving as an anode to be electrically contactable with a car cigarette lighter and connectable to said housing; an electrically conductive member serving as a cathode to be electrically contactable with said car cigarette lighter and partially exterior to said housing; a plug fuse including two first electrically conductive terminals mounted thereto and in electrical connection with said electrically conductive connector as well as said electrically conductive member respectively; a lighting element, which is provided for brightening said compass and indicating the connecting status of said electrically conductive connector and said electrically conductive member with said car cigarette lighter, including two second electrically conductive terminals mounted thereto and in electrical connection with said electrically conductive connector as well as said electrically conductive member respectively; said plug fuse and said lighting element being receivable within the internal space of said housing; and an extendable power cord, which is partially receivable within the internal space of said housing and provided to utilize battery power distantly, including two third electrically conductive terminals mounted thereto and in electrical connection with said electrically conductive connector as well as said electrically conductive member respectively so that when said car circuit adapter is inserted into said car cigarette lighter, said electrically conductive connector which serves as an anode and said electrically conductive member which serves as a cathode electrically contact said car cigarette lighter to be ready to serve.

2. A car circuit adapter as claimed in claim 1, wherein said housing comprises one end portion, which is connectable with said electrically conductive connector, having an opening formed thereon for said plug fuse to extend therethrough and electrically contact said electrically conductive connector, a first internal chamber formed thereon for receiving therein said plug fuse, a second internal chamber formed thereon for securely receiving therein said electrically conductive member, and a third internal chamber including a fixture formed therein to fix said lighting element thereto.

3. A car circuit adapter as claimed in claim 2, wherein said end portion of said housing comprises an external thread formed thereon and said electrically conductive connector comprises an internal thread formed thereon so as to screwedly connect and securely lock said housing.

* * * * *